US008827181B2

(12) United States Patent
Nolte et al.

(10) Patent No.: US 8,827,181 B2
(45) Date of Patent: Sep. 9, 2014

(54) SHAPING AIR RING COMPRISING AN ANNULAR CAVITY AND CORRESPONDING BELL CUP

(75) Inventors: Hans-Jurgen Nolte, Besigheim (DE); Andreas Fischer, Ludwigsburg (DE); Peter Marquardt, Steinheim (DE); Jurgen Berkowitsch, Neuhausen (DE)

(73) Assignee: Durr Systems GmbH, Bietigheim Bissingen (DE)

( * ) Notice: Subject to any disclaimer, the term of this patent is extended or adjusted under 35 U.S.C. 154(b) by 1244 days.

(21) Appl. No.: 12/517,921

(22) PCT Filed: Dec. 5, 2007

(86) PCT No.: PCT/EP2007/010561

§ 371 (c)(1),
(2), (4) Date: Sep. 21, 2010

(87) PCT Pub. No.: WO2008/068005

PCT Pub. Date: Jun. 12, 2008

(65) Prior Publication Data

US 2011/0000974 A1 Jan. 6, 2011

(30) Foreign Application Priority Data

Dec. 6, 2006 (DE) ..... 10 2006 057 596

(51) Int. Cl.
*B05B 1/28* (2006.01)

(52) U.S. Cl.
USPC ..... 239/290; 239/223; 239/291; 239/296

(58) Field of Classification Search
USPC ..... 239/700–703, 223, 225.1, 290, 291, 239/296, 589, 589.1
See application file for complete search history.

(56) References Cited

U.S. PATENT DOCUMENTS

| | | | | |
|---|---|---|---|---|
| 4,760,965 | A | 8/1988 | Schneider | |
| 5,704,977 | A | 1/1998 | Baumann et al. | |
| 6,053,428 | A | 4/2000 | Van Der Steur | |
| 7,611,069 | B2 * | 11/2009 | Clifford et al. | 239/7 |
| 2004/0069877 | A1 | 4/2004 | Schaupp | |
| 2005/0001077 | A1 * | 1/2005 | Kon et al. | 239/700 |

FOREIGN PATENT DOCUMENTS

| | | | |
|---|---|---|---|
| DE | 102006022057 | A2 | 10/1984 |
| DE | 4306800 | A1 | 9/1994 |
| DE | 4439924 | A1 | 5/1996 |
| DE | 19938093 | A1 | 2/2001 |
| DE | 102005015604 | A1 | 10/2006 |
| DE | 102006045631 | A1 | 4/2008 |

(Continued)

OTHER PUBLICATIONS

PCT International Search Report for EP2007/010561 dated Apr. 17, 2008.

*Primary Examiner* — Jason Boeckmann
(74) *Attorney, Agent, or Firm* — Bejin Bieneman PLC

(57) ABSTRACT

A guiding air ring for a rotary atomiser for coating components, such as motor vehicle body parts, is disclosed. The ring generally includes a front side facing a bell plate of the rotary atomiser in the operating state, and at least one guiding air nozzle for outputting a guiding air flow for forming a directed spray emitted from the bell plate. The ring may also include a cavity which is rotationally arranged in the front side of the guiding air ring in an annular manner. A correspondingly adapted bell plate is also disclosed.

10 Claims, 5 Drawing Sheets

(56) References Cited

FOREIGN PATENT DOCUMENTS

| | | | |
|---|---|---|---|
| EP | 0120648 | A2 | 10/1984 |
| EP | 0245849 | A2 | 11/1987 |
| EP | 1250960 | A2 | 10/2002 |
| EP | 1331037 | A2 | 7/2003 |
| EP | 1426113 | A2 | 6/2004 |
| GB | 2294214 | A | 4/1996 |
| JP | 07-024367 | | 1/1995 |
| JP | 08099052 | A | 4/1996 |
| JP | 09085134 | A | 3/1997 |
| JP | 2001113207 | A | 4/2001 |

* cited by examiner

SHAPING AIR RING COMPRISING AN ANNULAR CAVITY AND CORRESPONDING BELL CUP

CROSS-REFERENCE TO RELATED APPLICATIONS

This application is a National Phase application claiming the benefit of International Application No. PCT/EP2007/010561, filed Dec. 5, 2007, which claims priority to German Patent Application No. DE 10 2006 057 596.2, filed Dec. 6, 2006, the complete disclosures of which are hereby incorporated in by reference in their entireties.

FIELD

The present disclosure relates to a shaping air ring for a rotary atomiser and to a bell cup.

BACKGROUND

In modern paintshops rotary atomisers are conventionally used for series coating of components, such as motor vehicle body parts, which apply a spray jet of a coating composition (e.g. liquid paint) onto the components to be coated by means of a rotating bell cup. Further, a shaping air ring may be arranged at the end face of such a rotary atomiser, which shaping air ring annularly surrounds the bell cup shaft and at its end face comprises a ring of shaping air nozzles with a large number of shaping air nozzles distributed annularly over the circumference, out of which a shaping air stream may be discharged towards the spray jet from behind, in order to shape the spray jet.

In one particular construction of such a rotary atomiser, the bell cup is partially encased, i.e. the shaping air ring surrounds the outer circumferential surface of the bell cup in the rear area of the bell cup, such that the shaping air ring displays axial overlap with the bell cup. A disadvantage of this construction, however is that "clearing air" is absolutely essential for preventing soiling of the rear of the bell cup.

In another construction of such a rotary atomiser, on the other hand, an annularly encircling gap is located in the axial direction between the shaping air ring and the bell cup, in the region of which gap the bell cup shaft is exposed and may therefore become soiled. With this construction problems may also arise if the rotary atomiser is cleaned in an automatic cleaning apparatus, since cleaning fluid may then penetrate into the annular gap between the shaping air ring and the bell cup.

Accordingly, there is a need for an improved rotary atomiser.

DESCRIPTION OF THE DRAWINGS

Various advantageous aspects of the present disclosure are explained in detail below with reference to the Figures together with the description of the exemplary illustrations. In the drawings.

DETAILED DESCRIPTION

Figure 1:
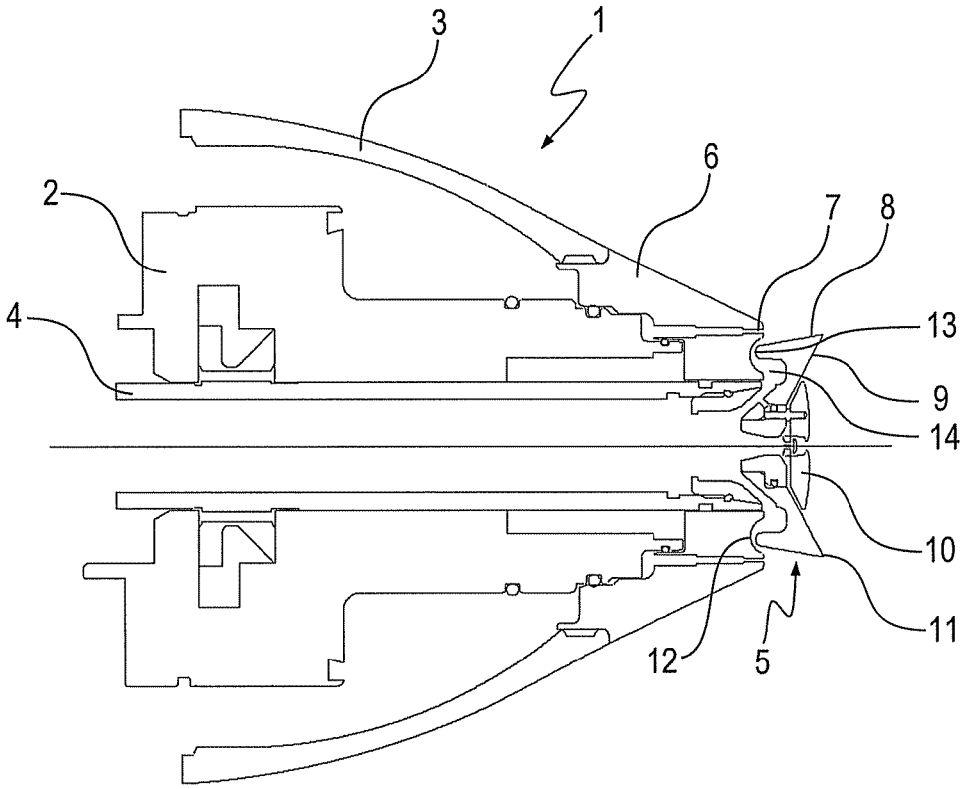
FIG. 1 is a cross-sectional view of an exemplary rotary atomiser having a shaping air ring and a bell cup, the bell cup being of relatively short construction in the axial direction.

The present disclosure comprises the general technical teaching of providing an annular cavity in the shaping air ring at the end face, into which annular cavity an appropriately adapted rear edge of the bell cup projects when the rotary atomiser is in operation. The annular cavity may thus be circular and arranged coaxially with the axis of rotation of the bell cup, the diameter of the annular cavity corresponding to the diameter of the rear edge of the associated bell cup, so that the bell cup rear edge may project axially into the annular cavity in the shaping air ring. The above dimensioning rule may apply to the middle of the annular cavity, since the annular cavity has a specific radial extent.

The bell cup rear edge may here lie flush with the end face of the shaping air ring or be set back in the axial direction into the annular cavity of the shaping air ring. In this case, the axial overlap between the shaping air ring and the bell cup may lie, for example, in the range from 1-3 mm or more. In one example, the annular cavity comprises a depth in the axial direction of at least 1 mm or at least 3 mm, thereby allowing the above-mentioned axial overlap between the shaping air ring and the bell cup.

In one exemplary illustration, the shaping air ring comprises a plurality of rings of shaping air nozzles with in each case a plurality of annularly distributed shaping air nozzles, the individual rings of shaping air nozzles each discharging a shaping air stream onto the spray jet, in order to shape the spray jet. Discharge of a plurality of shaping air streams from various rings of shaping air nozzles advantageously allows more flexible shaping of the spray jet, since the individual shaping air streams may be adjusted independently of one another. The individual rings of shaping air nozzles may in this case be arranged circularly and/or coaxially with the bell cup shaft.

In an exemplary variant of the shaping air ring with two rings of shaping air nozzles for discharge of two independently adjustable shaping air streams, the two rings of shaping air nozzles have substantially identical diameters. A shaping air nozzle from the one ring of shaping air nozzles and a shaping air nozzle from the other ring of shaping air nozzles are then in each case distributed alternately over the circumference of the shaping air ring.

Further, with a plurality of rings of shaping air nozzles of identical diameter the possibility arises of distributing about the circumference of the shaping air ring groups of nozzles with in each case at least one shaping air nozzle from the one ring of shaping air nozzles and in each case at least one shaping air nozzle from the other ring of shaping air nozzles. The distance between the groups of nozzles adjacent in the circumferential direction may in this case be greater than the distance between the shaping air nozzles within the individual groups of nozzles. This is advantageous because the shaping air streams exiting from the nozzles belonging to one group of nozzles then merge, as a result of the small distance between these shaping air nozzles, to yield a resultant shaping air stream.

The individual groups of nozzles may be in each case pairs of nozzles, which comprise precisely one shaping air nozzle each from the one ring of shaping air nozzles and precisely one shaping air nozzle each from the other ring of shaping air nozzles.

However, the individual groups of nozzles in the rings of shaping air nozzles may also comprise a different number of shaping air nozzles, such as for example three or more shaping air nozzles per group of nozzles.

Furthermore, the possibility arises in the context of the present disclosure for the shaping air nozzles of the various rings of shaping air nozzles to be oriented differently, thus discharging the respective shaping air streams in different directions. For example, the shaping air nozzles of the one ring of shaping air nozzles may in each case display air discharge oriented substantially parallel to the axis of rotation of the bell cup. The shaping air nozzles of the other ring of shaping air nozzles may, on the other hand, display air discharge which exhibits swirl in the circumferential direction, such that the shaping air stream from these shaping air nozzles has a predetermined swirl angle relative to the axis of rotation of the bell cup. The swirl angle may lie, for example, in the range from 50° to 60°, with a swirl angle in the range from 30° to 45° having proven particularly advantageous. One advantage of such an orientation of the shaping air nozzles is that the shaping air streams may merge and then form a resultant shaping air stream with a specific orientation. In this way, three different geometries of the resultant shaping air flow may then be achieved with two shaping air streams, by turning the two shaping air streams on or off.

In addition, the possibility arises in the context of the present disclosure for the individual rings of shaping air nozzles to comprise different diameters, the individual rings of shaping air nozzles preferably being arranged coaxially with the axis of rotation of the bell cup.

However, there is alternatively the possibility of the individual rings of shaping air nozzles being arranged in the form of an ellipse around the bell cup shaft.

Furthermore, it is possible to have shaping air nozzle arrangements with a plurality of shaping air nozzles in each case being provided for discharging different shaping air streams, the individual shaping air nozzle arrangements being arranged not in a ring around the bell cup shaft, but rather in each case so as to form part of a circle.

The present disclosure also provides an appropriately adapted bell cup, which is constructed such that the bell cup rear edge projects, in the assembled state, axially into the annular cavity in the shaping air ring. The bell cup may therefore advantageously have a bell cup rear edge which displays substantially the same diameter as the annular cavity in the shaping air ring, so that the bell cup rear edge may project axially into the annular cavity.

Moreover, the radial extent of the bell cup rear edge may be smaller than the width of the annular cavity in the radial direction, so that the annular cavity in the shaping air ring accommodates the bell cup rear edge.

In one exemplary illustration, the bell cup has an external diameter in the range from 30-70 mm, an external diameter in the range from 35-50 mm having proven particularly advantageous.

In one exemplary variant of the bell cup, the radius of the bell cup at the annularly encircling spray release edge is greater than the axial extent of the outer circumferential surface of the bell cup from the bell cup rear edge up to the spray release edge. For example, the ratio between the radius of the bell cup and the axial extent of the circumferential surface of the bell cup may lie in the range from 1.2-1.8, a ratio in the range from 1.5-1.7 having proven particularly advantageous, if this relatively short construction is selected for the bell cup.

In another exemplary variant of the bell cup, on the other hand, the axial extent of the outer circumferential surface of the bell cup from the bell cup rear edge up to the spray release edge is greater than the radius of the bell cup at the annularly encircling spray release edge. For example, the ratio between the axial extent of the circumferential surface and the radius of the bell cup may lie in the range from 1.1-1.2, if this relatively long construction is selected for the bell cup.

Furthermore, the possibility arises in the context of the disclosure of the outer circumferential surface of the bell cup being concave in shape, i.e. exhibiting an indentation. Such a concave shape for the outer circumferential surface of the bell cup has the effect that the shaping air flow applies itself against the circumferential surface of the bell cup, thereby improving the action of the shaping air. Furthermore, the concave shaping of the outer circumferential surface of the bell cup leads to an improvement in cleaning action, when the bell cup is cleaned by external flushing with a flushing agent, since the flushing agent is then pressed against the circumferential surface of the bell cup.

However, the possibility alternatively also arises of an exemplary bell cup having a conical outer circumferential surface with a specific cone angle, the cone angle possibly lying for example in the range from 1-30°.

The outer circumferential surface of the bell cup may, for example, have an angle relative to the plane of rotation of the bell cup which lies in the range from 50°-89°. Furthermore, an exemplary bell cup may comprise an internal flow surface, which has an angle relative to the plane of rotation of the bell cup in the range from 1°-40°.

In addition, it is also possible for an exemplary bell cup to include an internal flow surface which is provided with a low-friction coating. Such a configuration of the flow surface of the bell cup is described in German patent application 10 2006 022 057, and the content of said patent application is hereby incorporated by reference in its entirety into the present disclosure with regard to the configuration of the flow surface.

Furthermore, an exemplary bell cup may comprise annularly encircling grooves at its outer circumferential surface, where the grooves form an undulating outer contour in the axial direction, thereby contributing to production of a boundary layer and thus improving the operating behavior of the bell cup.

Furthermore, an exemplary bell cup may be designed for external flushing, as is generally known. To this end, an exemplary bell cup may comprise an annularly encircling annular space at its rear, which is open towards the rear and is defined externally by the bell cup rear edge. In this case, the bell cup comprises an external flushing channel for external flushing of the outer circumferential surface of the bell cup with a flushing agent, the external flushing channel leading into the annular space, such that the flushing agent enters the annular space of the bell cup from the external flushing channel and from there arrives via a gap between the bottom of the annular cavity in the shaping air ring and the bell cup rear edge at the outer circumferential surface of the bell cup.

However, the present disclosure comprises not only the above-described exemplary shaping air rings and the exemplary bell cups likewise described above, but also a complete rotary atomiser with the exemplary shaping air ring and the exemplary bell cup.

The shaping air ring may in this case take the form of a separate component and be mounted on the rotary atomiser. However, there is alternatively also the possibility of the exemplary shaping air ring being an integral component of the rotary atomiser or of the rotary atomiser housing.

The shaping air ring may in this respect be configured such that the shaping air stream travels past the outside of the spray release edge of the bell cup with its centre line at a given radial distance therefrom. This means that the shaping air jet is not directed onto the outer circumferential surface of the bell cup but rather onto the spray jet, discharged at the spray release edge, outside the bell cup. The radial distance between the spray release edge of the bell cup and the centre line of the shaping air stream may here lie in the range from 0-6 mm, merely as an example.

The possibility even arises in this case of the shaping air stream not meeting up at all with the circumferential surface of the bell cup but rather traveling past the circumferential surface of the bell cup radially completely to the outside thereof.

Alternatively, however, there is also the possibility of the shaping air stream impinging with its centre line with a degree of radial overlap on the outer circumferential surface of the bell cup. This means that the shaping air stream is not directed onto the spray jet discharged at the spray release edge, but rather onto the outer circumferential surface of the bell cup. The radial overlap between the centre line of the shaping air stream and the outer circumferential surface of the bell cup may lie, for example, in the range from 0-5 mm.

The configuration of the exemplary bell cups or of the exemplary shaping air rings advantageously allows relatively low bell cup speeds of less than 20,000 revolutions per minute (RPM), 15,000 RPM, or even less than 12,000 RPM.

The low bell cup speed allows the necessary air pressure in turn to be lowered to less than 8 bar in the case of drive by means of an air turbine.

Furthermore, the construction of the exemplary shaping air ring or of the bell cup allows the shaping air flow rate to be limited to at most 600 Nl/min or even to less than 500 Nl/min.

In addition, it is possible for the bell cup to be driven by an electric motor, as described, for example, in German patent application 10 2006 045 631, and the content of said patent application is hereby incorporated by reference in its entirety into the present description.

Finally, the present disclosure also comprises an operating method for the rotary atomiser, in which two shaping air streams are switched on or off as desired, in order to influence spray jet width. To discharge a wide spray jet, just a first shaping air stream is discharged, which exhibits swirl in the circumferential direction, the swirl preferably being oriented counter to the direction of rotation of the bell cup. To discharge a particularly narrow spray jet, on the other hand, just a second shaping air stream is discharged, which is oriented coaxially with the axis of rotation of the bell cup. To discharge a spray jet of medium width, on the other hand, both shaping air streams are discharged, i.e. both the coaxially oriented shaping air stream and the shaping air stream with swirl. The two shaping air streams then merge to yield a resultant shaping air stream.

In addition, the possibility also arises in the for the coating composition applied with the spray jet to be electrostatically charged with a given charging voltage, the construction according to the exemplary shaping air rings or of the exemplary bell cups allowing a reduction in charging voltage to less than 70 kV, less than 50 kV or even to less than 30 kV.

A further advantageous feature of the exemplary rotary atomiser is the fact that the coating composition stream may be limited to, merely as examples, less than 600 ml/min, 500 nil/min or even to less than 400 ml/min.

A further advantageous feature of the exemplary rotary atomiser is that the droplet size in the spray jet may exhibit particularly good statistical distribution. For example, the median and/or the mean of the droplet size may be in the range between 20-800 μm, a range from 300-500 μm having proven particularly advantageous. Furthermore, the standard deviation of the droplet size may advantageously be less than 500 μm, a value of less than 400 μm or even less than 300 μm having proven particularly advantageous. With the exemplary rotary atomisers disclosed herein, the majority of the released coating composition droplets have a droplet size in the range from 20-800 μm.

It should additionally be mentioned that the exemplary rotary atomisers are suitable for the application as desired of liquid paint (e.g. solvent-based paint, water-based paint) or powder coating.

It should moreover be mentioned that the exemplary operating methods are suitable for interior coating or exterior coating of relatively small or narrow components. In the case of exterior coating, surfacer or clear coat material may be applied, as the exemplary operating methods may be less suitable for the application of special effect coatings.

Finally, it should also be mentioned that the exemplary rotary atomisers are suitable both for interior coating and for exterior coating.

Turning now to FIG. 1, which is a cross-sectional view of a rotary atomiser 1 with an air turbine 2, which is arranged in an atomiser housing 3 and drives a hollow bell cup shaft 4, a bell cup 5 being mounted at the end of the bell cup shaft 4.

A shaping air ring 6 is additionally fitted at the end face of the rotary atomiser 1, which shaping air ring comprises a ring of shaping air nozzles with a large number of shaping air nozzles 7, the shaping air nozzles 7 being oriented coaxially with the bell cup shaft 4 and discharging a shaping air stream in a forward direction coaxially with the bell cup shaft 4, in order to shape a spray jet discharged by the bell cup 5.

The bell cup 5 is of largely conventional construction and comprises a conical circumferential surface 8 on the outside and a likewise conical flow surface 9 on the inside. Furthermore, a deflector disc 10 is mounted at the front on the inside of the bell cup 5 to deflect coating composition, which enters the bell cup 5 axially from the hollow bell cup shaft 4, radially outwards onto the flow surface 9, such that the coating composition is finally released at an annularly encircling spray release edge 11 of the bell cup 5.

In this exemplary illustration, the shaping air nozzles 7 are oriented in the shaping air ring 6 in such a way that the centre line of the shaping air stream travels past the spray release edge 11 of the bell cup 5 radially to the outside thereof, the radial distance between the centre line of the shaping air stream and the spray release edge 11 amounting to roughly 3 mm.

It should additionally be mentioned that in this exemplary illustration the bell cup 5 has a relatively short axial structural length. For instance, in this exemplary illustration the ratio between the radius of the spray release edge 11 and the axial length of the circumferential surface 8 is roughly 1.6, i.e. the radius of the bell cup 5 is greater than its axial structural length.

Also of particular significance in this exemplary illustration is the fact that the shaping air ring 6 comprises a circular annular cavity 12 at the front end thereof, which extends coaxially with the bell cup shaft 4 and has an axial depth of roughly 2 mm. At the rear end of the circumferential surface 8 the bell cup 5 additionally comprises a bell cup rear edge 13, which projects axially rearwards into the annular cavity 12 in the shaping air ring 6, the axial overlap between the shaping air ring 6 and the bell cup 5 amounting to roughly 1 mm.

In addition, the bell cup 5 comprises an external flushing channel, which leads into an annular space 14 in the bell cup 5. In the case of external flushing of the bell cup 5, the flushing agent thus arrives in the annular space 14 via the external flushing channel and then passes outwards through the gap between the bell cup rear edge 13 and the bottom of the annular cavity 12 onto the outer circumferential surface 8 of the bell cup 5.

Figure 2:
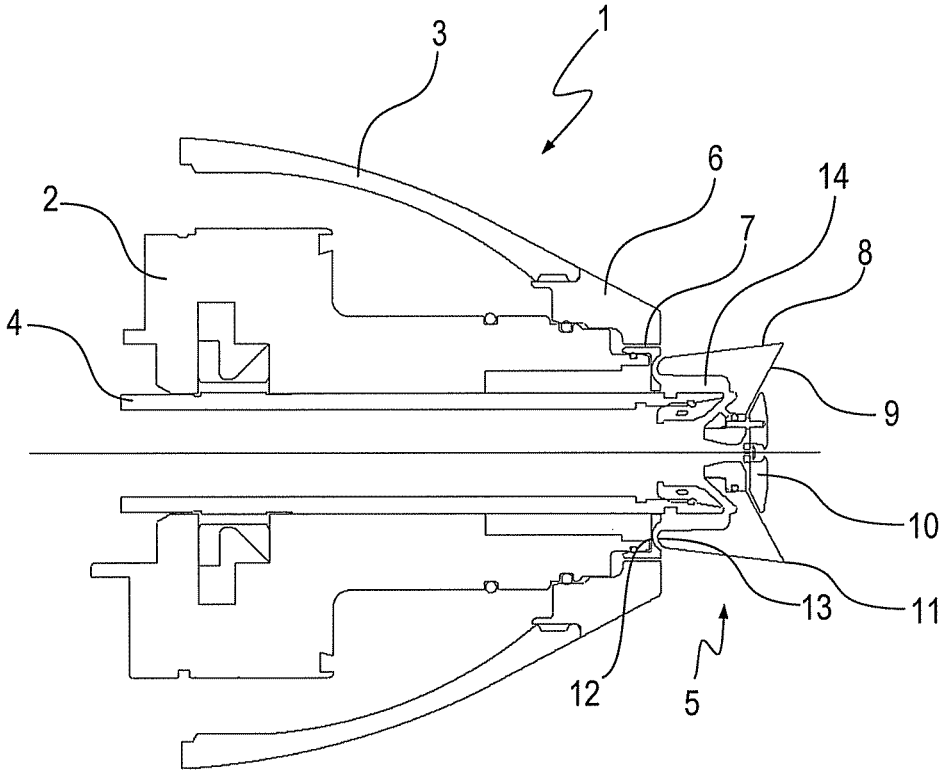
FIG. 2 is a cross-sectional view of an alternative exemplary rotary atomiser having a shaping air ring and a bell cup, the bell cup being of a relatively long axial structural length.

FIG. 2 shows a cross-sectional view of an alternative exemplary illustration of a rotary atomiser 1, which corresponds largely to the rotary atomiser 1 according to FIG. 1, such that, to avoid repetition, reference is made to the above description, the same reference numerals being used below for matching details.

A particular feature of this exemplary illustration is in the arrangement of the shaping air nozzles 7 in the shaping air ring 6. For instance, the shaping air nozzles 7 are here arranged in such a way that the centre line of the shaping air jet 7 impinges on the outside of the outer circumferential surface 8 of the rotary atomiser 5 with a radial overlap of approximately 2 mm. The shaping air jet is thus in this case directed directly onto the outer circumferential surface 8 of the bell cup 5.

A further particular feature of this exemplary illustration is in the relatively large axial structural length of the bell cup 5. For instance, in this exemplary illustration the axial extent of the outer circumferential surface 8 is greater than the radius of the spray release edge 11 of the bell cup 5.

Figure 3C:
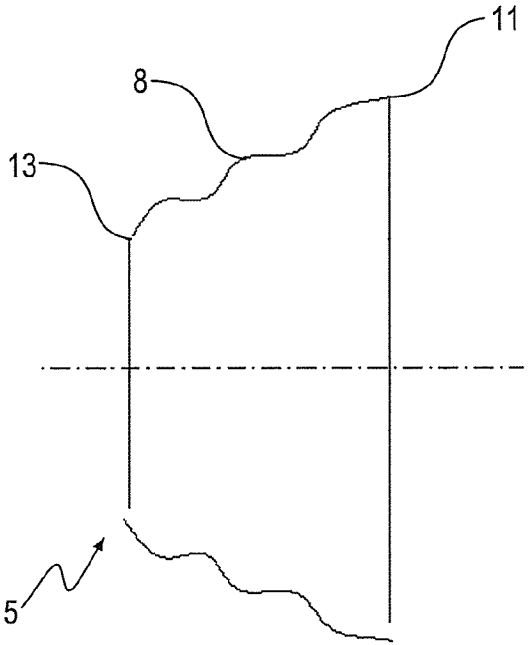
FIG. 3C shows a further exemplary illustration of a bell cup with a substantially conical circumferential surface and an undulating circumferential surface structure.
Figure 3B:
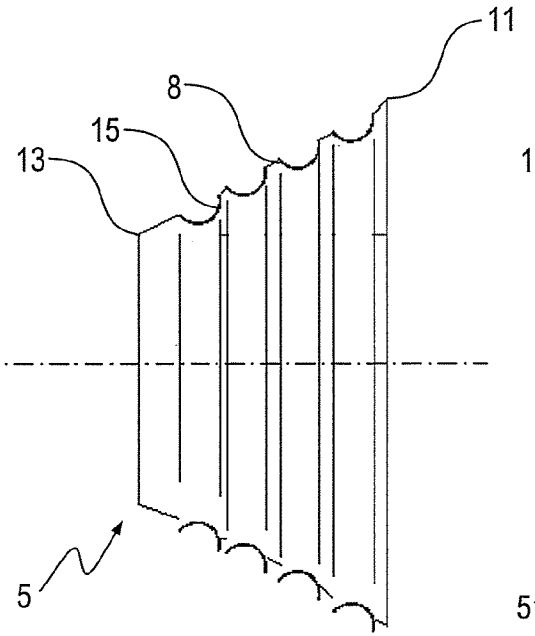
FIG. 3B is a cross-sectional view of an alternative exemplary illustration of a bell cup with a conical circumferential surface and circular grooves in the circumferential surface.
Figure 3A:
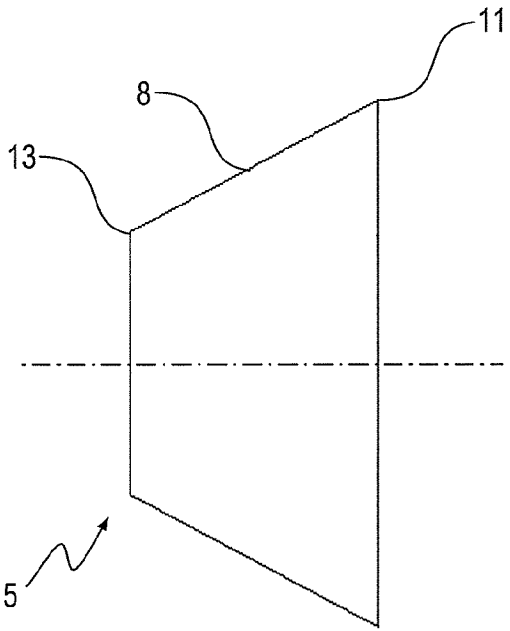
FIG. 3A is a cross-sectional view of an exemplary bell cup with a conical circumferential surface.

FIGS. 3A to 3C show various exemplary illustrations of bell cups 5, these exemplary illustrations largely matching the bell cup 5 according to FIGS. 1 and 2, such that, to avoid repetition, reference is largely made to the above description, the same reference numerals being used below for matching details.

In the case of the bell cup 5 according to FIG. 3A, the outer circumferential surface 8 is exactly conical, as is also the case in FIGS. 1 and 2.

In the exemplary bell cup shown in FIG. 3B, circular grooves 15 are arranged on the outside of the conical circumferential surface 8 of the bell cup 5, which grooves 15 improve boundary layer behavior at the circumferential surface 8 of the bell cup 5.

Finally, in the exemplary bell cup shown in FIG. 3C, the outer circumferential surface 8 of the bell cup 5 comprises an undulating structure in the axial direction, which likewise improves boundary layer behavior.

Figure 4:
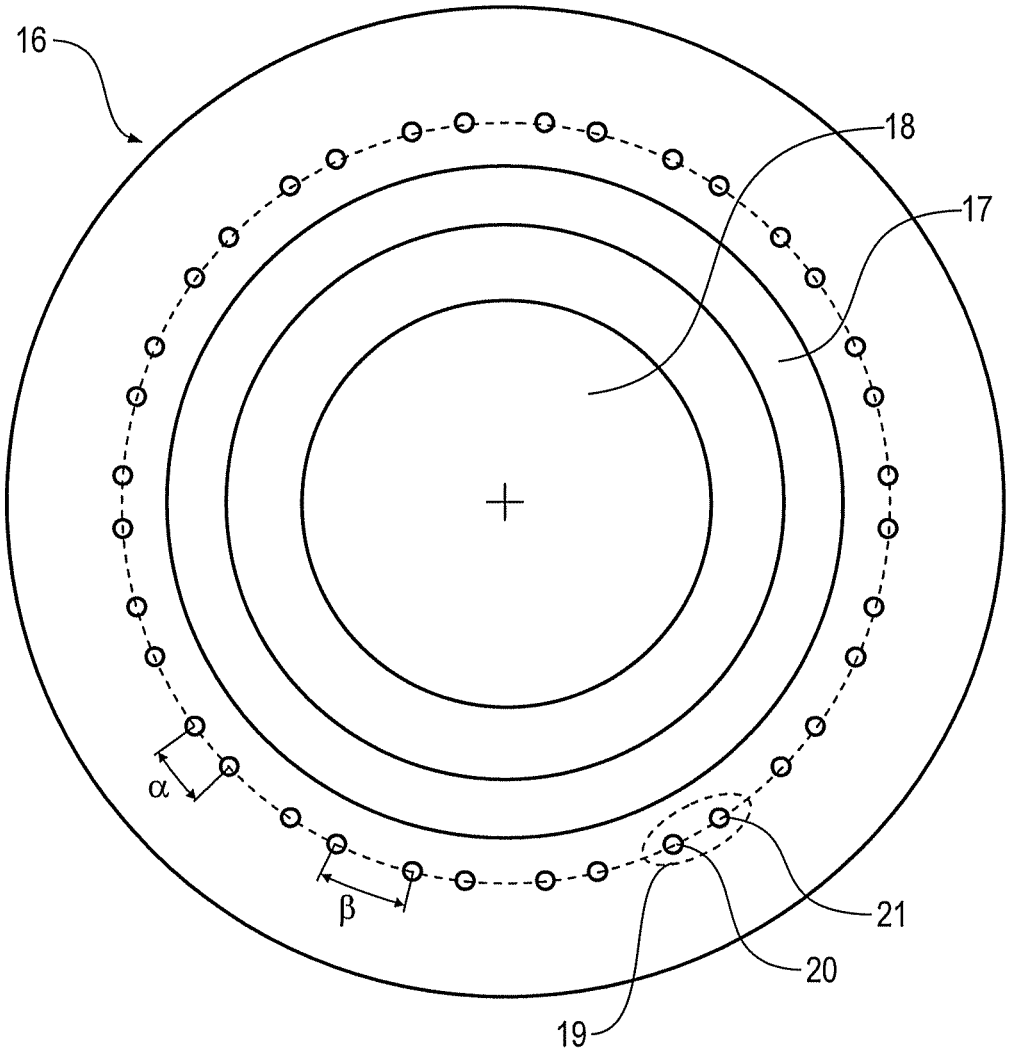
FIG. 4 is a schematic front view of an exemplary shaping air ring with two rings, of identical diameter, of shaping air nozzles

FIG. 4 is a front view of a further exemplary illustration of a shaping air ring 16.

In the end face of the shaping air ring 16, there is located an annular cavity 17, into which the rear edge of a bell cup projects in the assembled state, as has already been described above.

In addition, the shaping air ring 16 comprises a circular bore 18 in its centre, through which a bell cup shaft projects in the assembled state.

Outside the annular cavity 17 there are arranged two rings of shaping air nozzles, which both have the same diameter, such that in each case pairs 19 of nozzles comprising one shaping air nozzle 20 from the one ring of shaping air nozzles and one shaping air nozzle 21 from the other ring of shaping air nozzles are distributed around the circumference, the shaping air nozzles 20, 21 in the individual nozzle pairs 19 being arranged at a specific angular spacing $\alpha$. A shaping air stream may be discharged via each of the two rings of shaping air nozzles, which allows flexible shaping of the spray jet.

The adjacent pairs 19 of nozzles are arranged in this case in the circumferential direction at an angular spacing $\beta$, the angular spacing $\beta$ between the adjacent pairs 19 of nozzles being greater than the angular spacing a between the two shaping air nozzles 20, 21 that form one of the pairs 19.

The shaping air nozzle 20 of the individual pairs 19 of nozzles is here in each case oriented coaxially with respect to the axis of rotation of the bell cup and therefore discharges the associated shaping air jet coaxially forwards.

The other shaping air nozzle 21 of the individual pairs 19 of nozzles, on the other hand, is in each case skewed in the circumferential direction and therefore discharges the associated shaping air jet with a corresponding swirl.

On discharge of the two shaping air streams out of the two shaping air nozzles 20, 21, the two shaping air streams combine to yield a resultant shaping air stream with a specific direction and a specific aperture angle.

Figure 5:
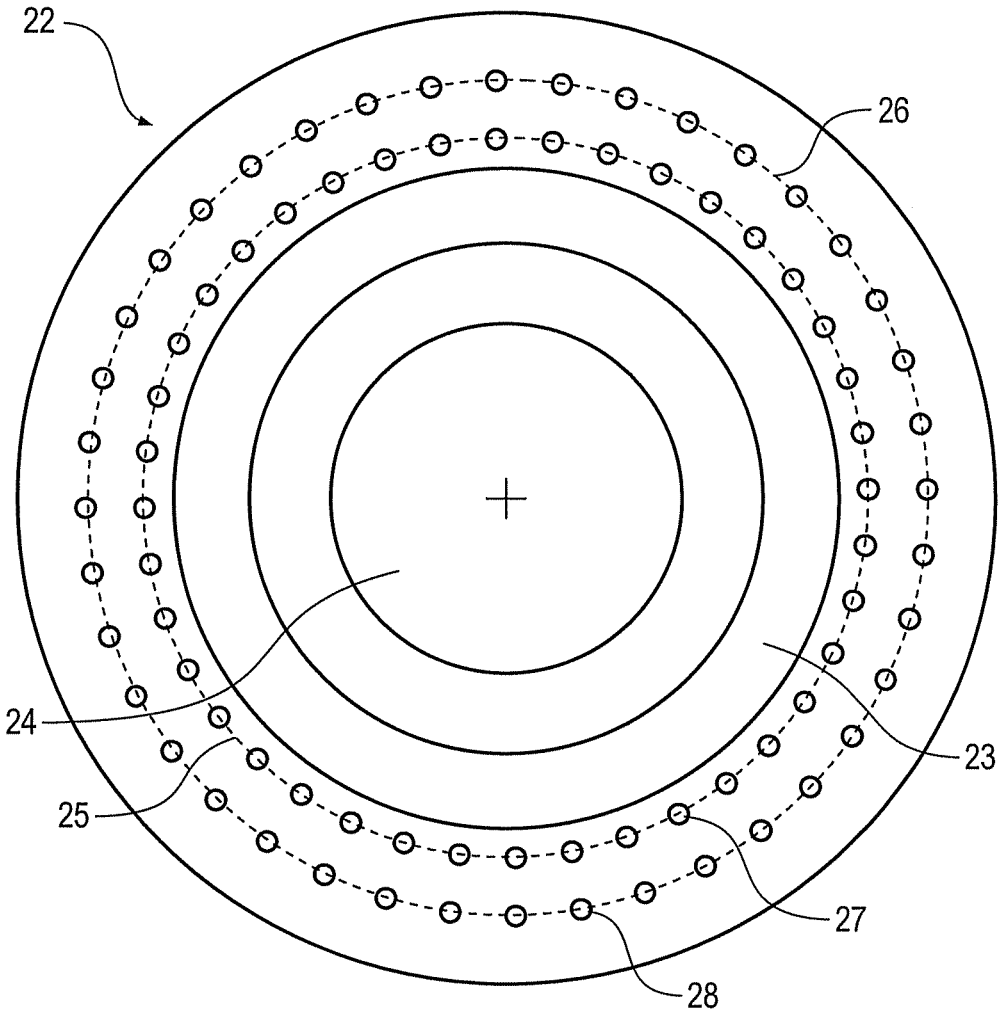
FIG. 5 is a schematic front view of an exemplary shaping air ring with two concentric rings, of different diameter, of shaping air nozzles.

Finally, FIG. 5 shows an alternative exemplary illustration of a shaping air ring 22 having an annular cavity 23, a centrally arranged bore 24 for a bell cup shaft and two rings of shaping air nozzles 25, 26. The two rings of shaping air nozzles 25, 26 each comprise a plurality of annularly distributed shaping air nozzles 27, 28, where each of the respective pluralities of nozzles 27, 28 have different diameters.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

The invention claimed is:

1. A shaping air ring for a rotary atomiser for coating components, comprising:

an end face, which in an operating state faces a bell cup of the rotary atomiser, at least one shaping air nozzle included in the end face and configured to discharge a shaping air stream for shaping a spray jet discharged by the bell cup, wherein the shaping air nozzle is configured to discharge the shaping air stream substantially perpendicularly to a plane indicated by a substantially flat portion of the end face, and an annular cavity that is substantially circular, that forms an indentation in the substantially flat portion of the end face, and that is arranged in an annularly encircling manner in the end face of the shaping air ring; wherein a line tangent to a rear-most portion of the annular cavity is substantially parallel to the plane indicated by the substantially flat portion of the end face.

2. The shaping air ring according to claim 1, wherein the annular cavity has a depth in the axial direction of at least 1 mm.

3. The shaping air ring according to claim 1, further comprising a first ring of shaping air nozzles comprising a plurality of annularly distributed shaping air nozzles configured to discharge a first shaping air stream, and a second ring of shaping air nozzles comprising a plurality of annularly distributed shaping air nozzles configured to discharge a second shaping air stream.

4. The shaping air ring according to claim 3, wherein the two rings of shaping air nozzles have substantially the same diameter, and a shaping air nozzle from the first ring of shaping air nozzles and a shaping air nozzle from the second ring of shaping air nozzles are in each case distributed alternately over the circumference of the shaping air ring.

5. The shaping air ring according to claim 3, wherein groups of nozzles are distributed over the circumference which comprise in each case at least one shaping air nozzle from the first ring of shaping air nozzles and in each case at least one shaping air nozzle from the second ring of shaping air nozzles, and the distance between the adjacent groups of nozzles is greater than the distance between the shaping air nozzles of the individual groups of nozzles.

6. The shaping air ring according to claim 5, wherein the individual groups of nozzles comprise in each case precisely one shaping air nozzle from the first ring of shaping air nozzles and in each case precisely one shaping air nozzle from the second ring of shaping air nozzles.

7. The shaping air ring according to claim 3, wherein the shaping air nozzles from the first ring of shaping air nozzles in each case display air discharge oriented substantially parallel to the axis of rotation of the bell cup.

8. The shaping air ring according to claim 7, wherein the shaping air nozzles from the second ring of shaping air nozzles in each case display air discharge which exhibits swirl in the circumferential direction, the swirl being oriented as desired in the direction of rotation of the bell cup or contrary to the direction of rotation of the bell cup.

9. The shaping air ring according to claim 8, wherein the shaping air nozzles exhibiting swirl have a swirl angle which lies in a range from 30° to 45°.

10. The shaping air ring according to claim 1, wherein, a plurality of shaping air nozzle arrangements are provided for discharging a plurality of independently adjustable shaping air streams onto the spray jet, the individual shaping air nozzle arrangements in each case discharge precisely one of the shaping air streams, the individual shaping air nozzle arrangements in each case comprise a plurality of shaping air nozzles, and the individual shaping air nozzle arrangements are in each case arranged in the form of a circle, an ellipse or part of a circle.

* * * * *

UNITED STATES PATENT AND TRADEMARK OFFICE

CERTIFICATE OF CORRECTION

PATENT NO. : 8,827,181 B2
APPLICATION NO. : 12/517921
DATED : September 9, 2014
INVENTOR(S) : Nolte et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1369 days.

Signed and Sealed this
Fifteenth Day of March, 2016

Michelle K. Lee

Michelle K. Lee
*Director of the United States Patent and Trademark Office*